US006109945A

United States Patent [19]

Creelle et al.

[11] Patent Number: 6,109,945

[45] Date of Patent: Aug. 29, 2000

[54] ELECTRICAL SEALED CONNECTOR

[75] Inventors: Eddy Creelle, Dendermonde; Sonny Van Dessel, Haacht, both of Belgium

[73] Assignee: Framatome Connectors International, Courbevoie, France

[21] Appl. No.: 09/116,736

[22] Filed: Jul. 16, 1998

[30] Foreign Application Priority Data

Jul. 17, 1997 [NL] Netherlands ..... 1006605

[51] Int. Cl.[7] ..... H01R 13/52; H01R 13/56

[52] U.S. Cl. ..... 439/278; 439/447

[58] Field of Search ..... 439/278, 447, 439/320, 324, 272; 403/348

[56] References Cited

U.S. PATENT DOCUMENTS

| | | | |
|---|---|---|---|
| 4,531,802 | 7/1985 | Tomsa | 339/90 R |
| 5,474,465 | 12/1995 | Kobayashi | 439/278 |
| 5,662,488 | 9/1997 | Alden | 439/314 |

FOREIGN PATENT DOCUMENTS

| | | |
|---|---|---|
| 0 570 650 A1 | 11/1993 | European Pat. Off. . |
| 2 494 508 A1 | 5/1982 | France . |
| 2 701 604 A1 | 8/1994 | France . |
| 2 077 055 | 12/1981 | United Kingdom . |

OTHER PUBLICATIONS

Dutch Search Report with English translation Feb. 17, 1998.

*Primary Examiner*—Lincoln Donovan
*Assistant Examiner*—Chandrika Prasad
*Attorney, Agent, or Firm*—Perman & Green, LLP

[57] ABSTRACT

A connector comprises first and second connector halves, each having a housing with a mainly circular cross section. The first connector half is matable with the second connector half by means of a rotatable coupling ring surrounding the first housing. In the coupled position an axially extending ring-shaped section of the second housing lies within the coupling ring. The first housing at least along a part of its axial length is received in a boot of elastic, resilient material, the boot being provided with a circumferential slot, in which a radially projecting inner edge of the coupling ring is received freely rotatably. In the coupled position a front sealing part of the boot is sealingly compressed against the axially extending ring-shaped section edge of the second housing.

13 Claims, 2 Drawing Sheets

ELECTRICAL SEALED CONNECTOR

BACKGROUND OF THE INVENTION

The invention relates to a connector, comprising first and second connector halves, each having a housing with a mainly circular cross-section, wherein the first connector half is matable with the second connector half by means of a rotatable coupling ring surrounding the first housing, wherein in the coupled position an axially extending ring-shaped edge of the second housing lies within the coupling ring.

The known connector of this type is an assembly of several seperate parts, such as a sealing means which must provide a sealing between both connector halves in the coupled position, a strain relief for the cable connected to the first connector half, and a spring means for providing a spring force operating in decoupling direction between both connector halves in the coupled position. With respect to manufacturing assembling the connector of several separate parts is disadvantageous.

The invention aims to provide an improved connector of the above-mentioned type.

SUMMARY OF THE INVENTION

To this end the connector according to the invention is characterized in that the first housing at least along a part of its axial length is received in a boot of elastic, resilient material, said boot being provided with a circumferential slot, in which a radially projecting inner edge of the coupling ring is received freely rotatably, wherein in the coupled position a front sealing part of the boot is sealingly compressed against the axially projecting edge of the second housing.

In this manner a connector is obtained, wherein the front part of the boot also operates as sealing between both connector halves in the coupled position. Rubber is for example suitable as eleastic, resilient material.

According to a preferred embodiment the coupling ring and the axial ring of the second housing are provided with cooperating coupling means which provide an audible signal when reaching the coupled position caused by a spring means, the compressed sealing part being operative as spring means. Thereby the sealing part of the boot also operates as spring means.

According the invention it is preferred when the first housing has a circumferential slot engaged by an inwardly directed thickening of the sealing part of the boot, wherein the thickening has a radial shoulder at its rear side, cooperating with a radial shoulder of the circumferential slot of the first housing during decoupling the connector. In this manner the first housing is retained in the boot with certainty.

According to the invention the axial length of the first housing is smaller than the axial length of the boot, wherein the boot has a shoulder at its inner side behind the first housing engaging the backside of the first housing to press the first housing towards the second housing in the coupled position. Thereby a complete coupling of the contact elements of the connector is guaranteed.

The invention will be further explained by reference to the drawings, in which an embodiment is schematically shown.

DETAILED DESCRIPTION OF THE INVENTION

Figure 1:
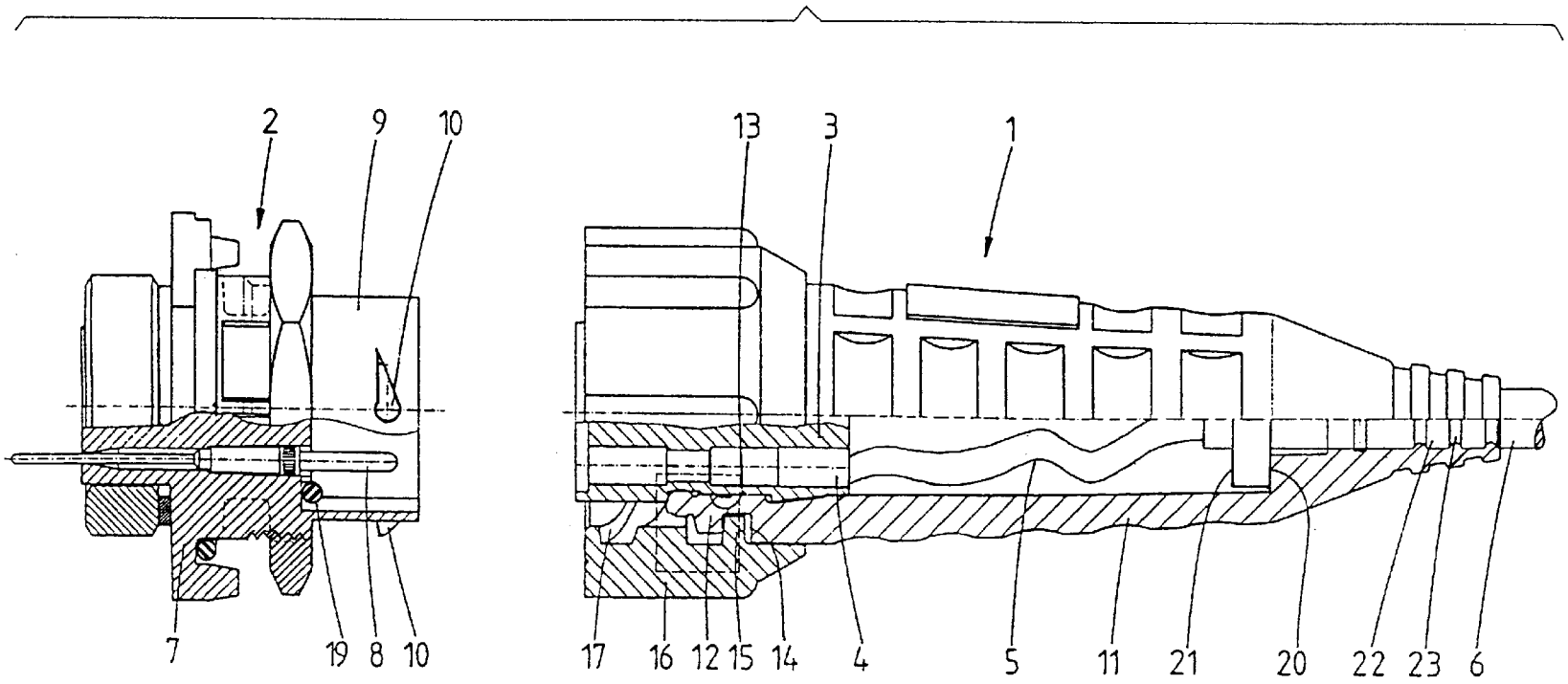
FIG. 1 shows both connector halves of an embodiment of the connector according to the invention in the decoupled position.

Referring to the drawings there is shown a connector comprising a first connector half 1 and a second connector half 2. The first connector half 1 comprises a first housing 3 of insulating material with a plurality of electrical contact elements 4, only one of which is shown in the drawings. The wires 5 of a cable 6 are connected to the contact elements 4.

The second connector half 1 comprises a second housing 7 of insulating material, in which a corresponding plurality of male contact elements 8 is provided, only one of which is shown. The second connector half 2 can be mounted on a wall of an apparatus not shown. The second housing 7 is provided with an axially extending ring-shaped shell section 9 carrying coupling lugs 10 at the outer side regularly arranged along the circumference.

In the connector shown the housing 3 of the first connector half is received along a part of its axial length in a boot or sheath 11 of eleastic resilient material, for example rubber. The boot 11 has an axial length which is significantly greater than the first housing 3. The boot 11 has a front part 12 operating as sealing and spring means as will be explained hereinafter. This front part 12 has an inwardly directed thicknening engaging into a circumferential slot 13 of the housing 3, whereby the boot 11 and the first housing 3 are interconnected firmly.

Figure 2:
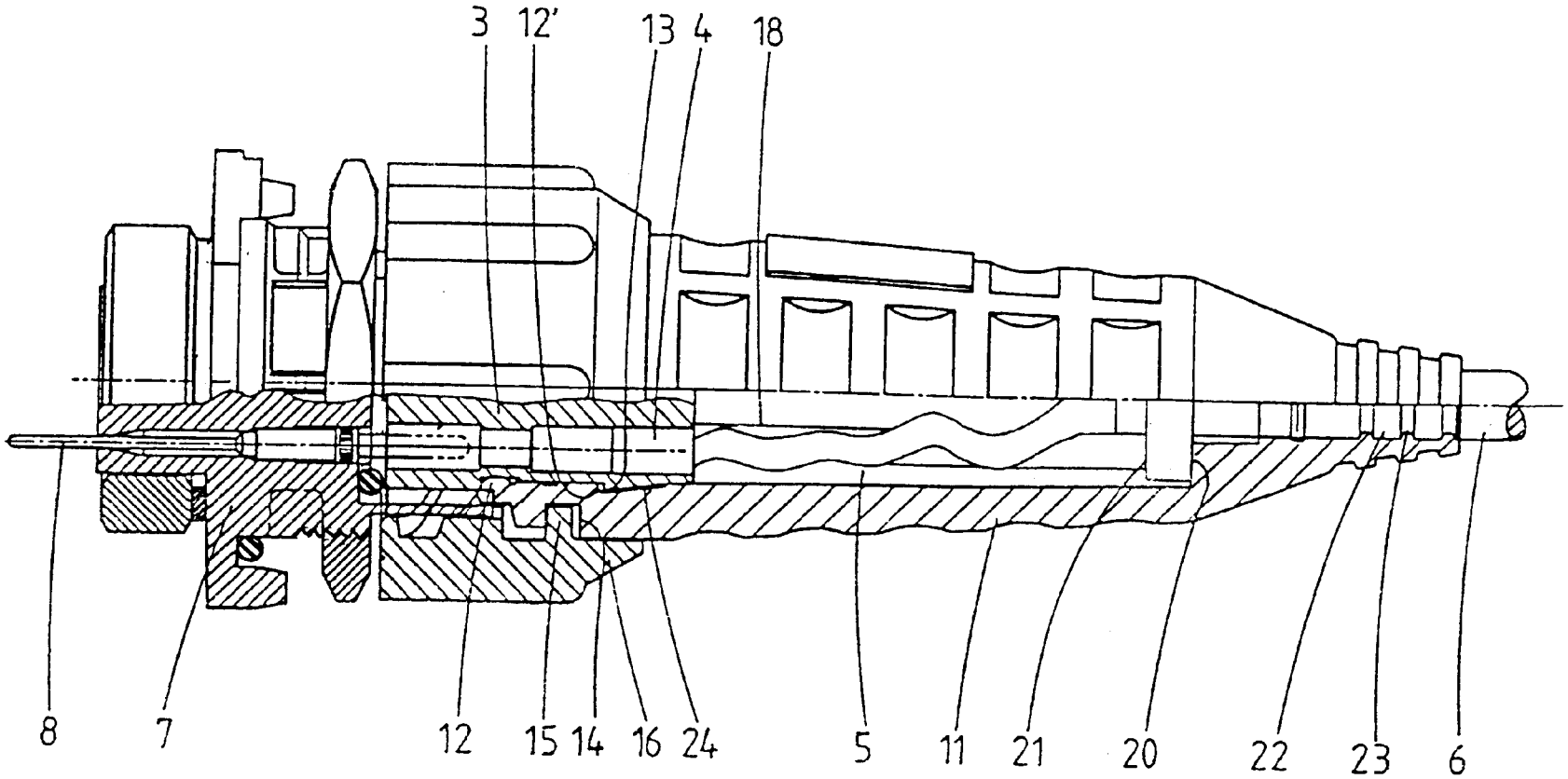
FIG. 2 shows both connector halves of the connector of FIG. 1 in coupled position.

The front part 12 of the boot 11 is further provided with a circumferential slot 14, a radially projecting inner edge 15 of a coupling ring 16 engaging into this slot 14. This coupling ring is mounted with the inner edge 15 being received freely rotatable in the circumferential slot. At its innerside the coupling ring 16 is further provided with a plurality of coupling slots 17 corresponding with the plurality of coupling lugs 10 of the second housing 7. When the connector halves 1, 2 are to be coupled or mated, the first housing of the connector half 1 is directed to the space within the shell section 9 of the second connector half 2, wherein the coupling lugs 10 are received in the entrances of the coupling slots 17. By rotating the coupling ring 16 the first housing 3 is pulled against the second housing 7, wherein the contact elements 4 and 8 are completely coupled with each other and finally the coupled position of FIG. 2 is reached. The reaching of the coupled position is signalled by an audible click provided by the coupling lugs 10 clicking behind edges of the coupling slots 17 not shown in the drawing as caused by the spring operation of the front part 12 of the boot 11.

This front part 12 is compressed between the front face of the inner shell section 15 and the edge 9 of the second housing 7, whereby on the one hand a sealing of the connector in the coupled position and on the other hand a spring operation for the desired signalling is provided. As schematically shown in FIG. 2, the front sealing part 12 of the boot 11 is sealingly pressed both against the shell section 9 and against the outer surface of the housing 3.

The decoupling movement of the connector is transferred to the connector housing via the back surface of the radially inwardly protruding inner edge of the coupling ring 16 and the circumferential slot 14 of the boot 11.

When the described connector is decoupled, the cooperation between the backside or shoulder 12' of the thickening of the sealing part 12 and the opposite edge or shoulder 13' of the circumferential slot 13 guarantees that housing 3 is moved away from the second connector half 2.

At its inner side behind the housing 3 the boot 11 is provided with a shoulder 18 engaging the backside of the first housing 3. During mating it is obtained in this manner that the housing 3 is pressed with certainty against an O-ring 19 of housing 7 and that the contact elements 4, 8 are completely coupled.

Further the boot 11 operates also as a strain relief. To this end a radial shoulder 20 is provided at the side opposite of the housing 3, said shoulder cooperating with a clamping ring 21 mounted on the cable 6.

Finally the end of the boot 11 opposite of the housing 3 is provided with a cable passage 22 with a plurality of inwardly directed edges 23 sealingly engaging the cable 6.

From the foregoing it will be clear that the connector described can be assembled from a relatively few number of parts so that manufacturing of the connector is relatively simple.

The cooperation between the shoulder 12' of the thickening of the sealing part 12 of the boot 11 and the shoulder 13' of the circumferential slot 13 is improved in that a slot 24 is formed in the inner wall of the boot 11 behind the thickening, while the housing 3 from the backside in the direction of the circumferential slot 13 has a gradually increasing diameter, so that the cooperating shoulders 12' and 13' are relatively great.

The connector shown in the drawings is described as an example only and the invention is not restricted to this embodiment. Within the scope of the claims several variations are possible.

What is claimed is:

1. Connector, comprising first and second connector halves, each having a housing with a mainly circular cross section, wherein the first connector half is matable with the second connector half by means of a rotatable coupling ring surrounding the first housing, wherein in the coupled position an axially extending ring-shaped section of the second housing lies within the coupling ring, characterized in that the first housing at least along a part of its axial length is received in a boot of elastic, resilient material, said boot being provided with a circumferential slot, in which a radially projecting inner edge of the coupling ring is received freely rotatably, wherein in the coupled position a front sealing part of the boot is sealingly compressed by the coupling ring against the axially extending ring-shaped section of the second housing.

2. Connector according to claim 1, wherein the coupling ring and the axially extending ring-shaped section of the second housing are provided with cooperating coupling means which provide an audible signal when reaching the coupled position caused by a spring means, the front sealing part of the boot compressed against the axially extending ring-shaped section operating as the spring means causing the audible signal provided by the cooperative coupling means.

3. Connector according to claim 1, wherein the radially projecting inner edge of the coupling ring comprises a support shoulder, wherein in the coupled position the sealing part of the boot is compressed between the axially extending ring-shaped section of the second housing and the support shoulder of the coupling ring.

4. Connector according to claim 1, wherein the first housing has a circumferential slot engaged by an inwardly directed thickening of the sealing part of the boot.

5. Connector according to claim 4, wherein the thickening has a radial shoulder at its rear side, cooperating with a radial shoulder of the circumferential slot of the first housing during decoupling the connector.

6. Connector according to claim 5, wherein a slot is provided in the inner side of the boot behind the thickening, while the first housing has a diameter gradually increasing from the backside towards the circumferential slot.

7. Connector according to claim 1, wherein the axial length of the first housing is smaller than the axial length of the boot, wherein the boot has a shoulder at its inner side behind the first housing engaging the backside of the first housing to press the first housing towards the second housing in the coupled position.

8. Connector according to claim 1, wherein the boot at its end opposite of the first housing is provided with a radial shoulder.

9. Connector according to claim 8, wherein the boot at said end is provided with a cable passage having one or more inwardly directed sealing edges.

10. Connector according to claim 8 with a cable connected to the first connector half, wherein a clamping ring is mounted on the cable engaging said radial shoulder of the boot.

11. Connector according to claim 1, wherein in the coupled position the front sealing part of the boot is sealably compressed between an inner circumferential surface of the axially extending ring-shaped section and an outer surface of the first housing.

12. A sealed electrical connector comprising:

a first connector half, the first connector half including a contact housing having a substantially cylindrical shape, a portion of the contact housing being disposed in a boot of elastic resilient material;

a second connector half to be mated to the first connector half, the second connector half having a generally cylindrical shell section adapted to receive therein a portion of the contact housing when the first and second connector halves are mated; and a coupling ring for coupling the first connector half to the second connector half, the coupling having a radial flange located in a generally circumferential slot of the boot;

wherein when the first connector half is coupled to the second connector half, the cylindrical shell section of the second connector half is disposed at least in part around the boot, pressing the boot against the contact housing, and wherein the radial flange of the coupling ring axially biases the boot against the cylindrical shell section.

13. A sealed electrical connector in accordance with claim 12, wherein the axial bias of the boot against the cylindrical shell section resiliently urges a lug depending from the cylindrical shell section behind an edge of a lug receiving slot in the coupling ring for securing the coupling ring to the second connector half.

* * * * *